US005687940A

United States Patent [19]

England

[11] Patent Number: 5,687,940

[45] Date of Patent: Nov. 18, 1997

[54] ADJUSTABLE FOOT FOR UPHOLSTERED FURNITURE

[75] Inventor: Rodney D. England, Tazewell, Tenn.

[73] Assignee: England Corsair Upholstery Manufacturing Co., Inc., New Tazewell, Tenn.

[21] Appl. No.: 589,402

[22] Filed: Jan. 22, 1996

[51] Int. Cl.[6] ..... F16M 11/24

[52] U.S. Cl. ..... 248/188.2; 297/344.12

[58] Field of Search ..... 248/188.2, 188.3, 248/188.4, 188.5, 188.8; 297/344.12

[56] References Cited

U.S. PATENT DOCUMENTS

| | | | |
|---|---|---|---|
| 575,806 | 1/1897 | Garvey | 248/188.2 |
| 1,655,611 | 1/1928 | Jensen | 248/188.2 |
| 2,366,867 | 1/1945 | Nichthauser . | |
| 2,527,905 | 10/1950 | Barecki | 297/344.12 X |
| 2,803,510 | 8/1957 | Carbary | 312/253 |
| 2,877,875 | 3/1959 | Bolt | 189/34 |
| 2,933,850 | 4/1960 | Martin . | |
| 3,718,306 | 2/1973 | Murray | 248/188.8 |
| 3,799,484 | 3/1974 | Muller et al. | 248/188.2 |
| 3,834,548 | 9/1974 | Cliffton et al. | 211/118 |
| 4,068,815 | 1/1978 | Losert | 248/188.2 |
| 4,516,508 | 5/1985 | Kako et al. | 108/7 |
| 4,735,394 | 4/1988 | Facco | 248/188.2 X |
| 4,830,320 | 5/1989 | Bellows | 248/188.2 |
| 4,925,137 | 5/1990 | Hastings | 248/188.2 X |

*Primary Examiner*—Ramon O. Ramirez

*Attorney, Agent, or Firm*—Rhodes Coats & Bennett, L.L.P.

[57] ABSTRACT

An adjustable-height upholstered seat includes a frame including a support for a seated person at a seat height, the frame including a bottom having a plurality of slots formed therein, each the slots having a groove extending from either side thereof, a plurality of furniture feet each including a generally wedge-shaped body having a thickness, a first end, and a second end having a lower portion and a plurality of holes, and a plurality of pins each having two ends and a length greater than the thickness of a respective body, each of the pins inserted into a selected one of the holes in a respective furniture foot so each pin end protrudes from its furniture foot, each the furniture foot body located in one of the slots in the bottom of the frame, with the protruding pin lodged in the groove in the frame member and the first end extending below the frame member outside of the slot, to form a foot on the upholstered seat, whereby the seat height may be adjusted by inserting the pins in different ones of the holes in the furniture foot.

20 Claims, 3 Drawing Sheets

ADJUSTABLE FOOT FOR UPHOLSTERED FURNITURE

BACKGROUND OF THE INVENTION

The present invention relates to improvements in feet for furniture, particularly upholstered furniture.

Conventionally, upholstered furniture is manufactured at a manufacturing plant to preset specification and shipped to a customer and remains virtually unchanged throughout its useful life. If the customer is dissatisfied with some aspect of the upholstered furniture, any revision will,require professional assistance.

One such revision that might be contemplated is an adjustment of the height of the seat. For example, taller people would appreciate having the seat height of a chair or sofa somewhat higher than shorter people, and it would be useful if the seat could be modified to accommodate that desire. In addition, some consumers prefer to have the seat tilted backward to provide more comfort for lounging. Others, particularly the elderly or infirm, have trouble arising from conventional seats and could be assisted if the seat were tilted forwardly.

Heretofore, seats have not been amenable to modifications of seat height or forward or rearward tilt. To effect any such modification in the past generally required, as noted above, professional assistance. As a result, most consumers put up with whatever unsuitability their furniture has had. Such consumers would benefit from and appreciate the possibility of adjusting their seat height and/or tilt to suit their personal preferences, if such could be accomplished conveniently and still provide a finished-looking seat. Accordingly, there is a need in the art for furniture improvements to accommodate such consumers who desire adjustments in seat height or tilt.

SUMMARY OF THE INVENTION

The present invention fulfills this need in the art by providing a furniture foot for an upholstered seat. The foot has a body having a thickness, a first end, and a second end having a lower portion and a plurality of holes. Also included is a pin having two ends and a length greater than the thickness of the body. The pin may be inserted into one of the holes so each pin end protrudes from the body. The body may be located in a slot in a bottom of a frame member of an upholstered seat, with the protruding pin lodged in a groove in the frame member and the first end extending below the frame member outside of the slot, to form a foot on the upholstered seat. In a preferred embodiment, the body is generally wedge-shaped, the first end is tapered, and the second end is considerably wider than the first end.

Typically, the holes are aligned with one another along a line that is generally transverse to a line between the first end and the second end. Preferably, there are at least three of the holes, and the holes are aligned with one another along a curved line that is generally transverse to a line between the first end and the second end.

The lower portion is usually configured for solid contact with a flat floor at a plurality of orientations, such as by being curved. In a preferred embodiment, the first end terminates in a flat tab.

The invention also provides an adjustable-height upholstered seat including a frame including a support for a seated person at a seat height, the frame including a bottom having a plurality of slots formed therein, each the slot having a groove extending from either side thereof. A plurality of furniture feet each include a body having a thickness, a first end, and a second end having a lower portion and a plurality of holes, and a plurality of pins each having two ends and a length greater than the thickness of a respective body. Each of the pins is inserted into a selected one of the holes in a respective furniture foot so each pin end protrudes from its furniture foot, and each of the furniture foot bodies is located in one of the slots in the bottom of the frame, with the protruding pin lodged in the groove in the frame member and the first end extending below the frame member outside of the slot, to form a foot on the upholstered seat. The seat height may be adjusted by inserting the pins in different ones of the holes in the furniture foot.

Preferably, the plurality of furniture feet are four in number and are identical. Typically, the slots are slightly wider than the thickness of the furniture feet.

The invention also provides a method of adjusting the height of an upholstered seat. The method includes the steps of inserting a pin in a selected one of a plurality of holes in a furniture foot that has a body having a thickness, a first end, and a second end having a lower portion, and doing the same with additional pins and furniture feet to make a plurality of pinned furniture feet. The method also includes providing a frame for support of a seated person, the frame including a bottom having a plurality of slots formed therein, each slot having a groove extending from either side thereof. The method proceeds by locating each of the pinned furniture feet in one of the slots in the bottom of the frame with the first end below the frame member outside of the slot, and lodging the protruding pin in the groove in the frame member to form a foot on the upholstered seat.

The method may also include changing the height of at least a portion of the seat by removing at least one of the pinned furniture feet from a slot on the bottom of the frame, changing the hole in which the pin is inserted, and relocating the foot in a slot.

Thus, the seat may be tilted forward by locating the pins in holes in forward-most furniture feet to cause the effective height of the forward-most feet to be shorter than the height of rear feet. Or, the seat may be tilted rearward by locating the pins in holes in rearward-most furniture feet to cause the effective height of the rearward-most feet to be shorter than the height of forward feet.

BRIEF DESCRIPTION OF THE DRAWINGS

The invention will be better understood after a reading of the Detailed Description of the Preferred Embodiments and a review of the drawings in which.

DETAILED DESCRIPTION OF THE PREFERRED EMBODIMENTS

Figure 1:
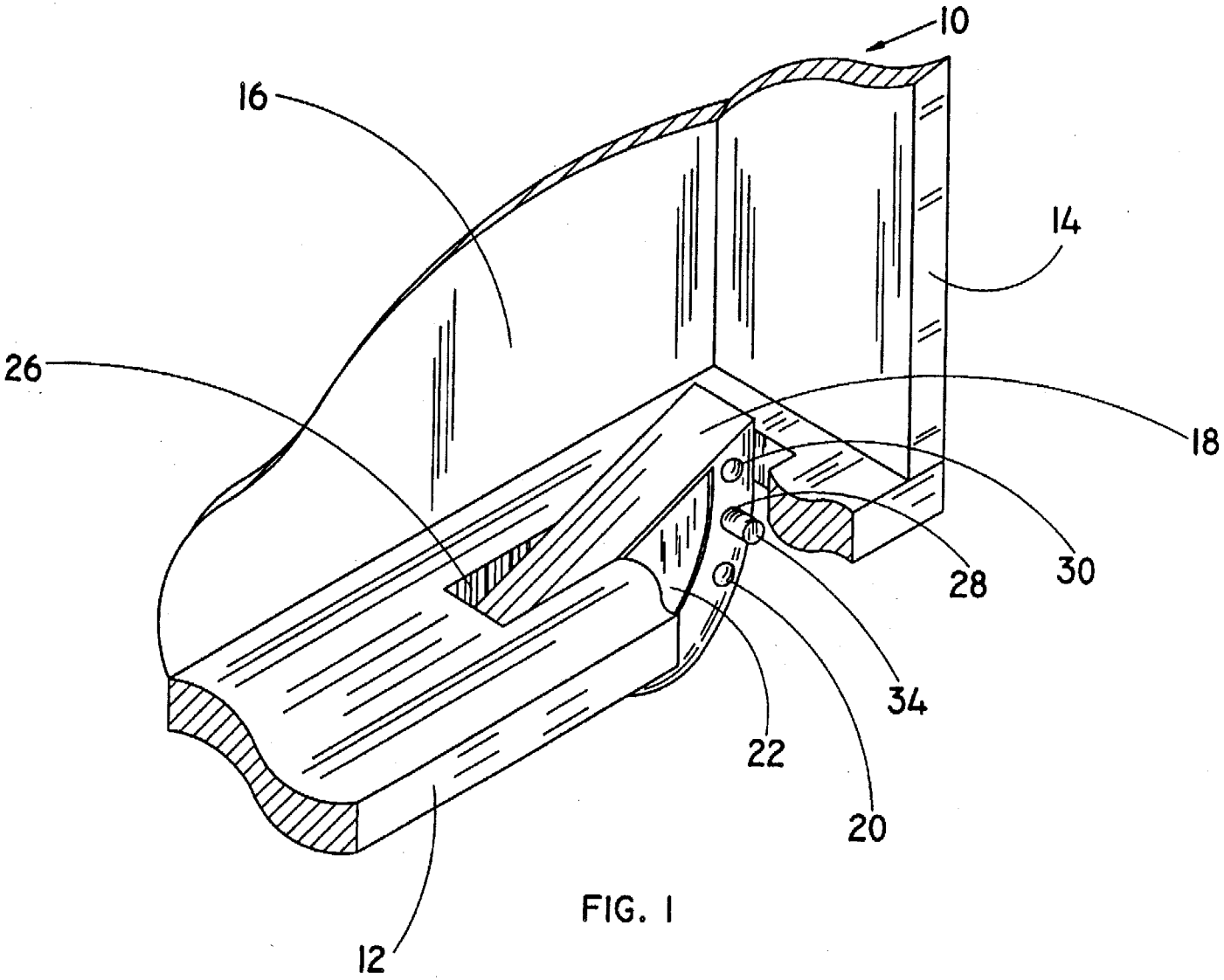
FIG. 1 is a perspective view of a preferred embodiment of the furniture foot installed in an upholstery frame, without the upholstery.

As seen in FIG. 1, the furniture foot 18 is located in a bottom frame member 12 of an upholstered seat 10. The seat 10 has upright frame members 14,16, as is conventional. As seen in FIG. 1, the upholstery has not been applied to the upholstered furniture so that the foot 18 can be more clearly seen. A portion of the foot 18 protrudes upwardly above the bottom frame 12 by an amount dependent upon the selection of the ones of several holes such as lower hole 20 in which the foot 18 is pinned.

Figure 2:
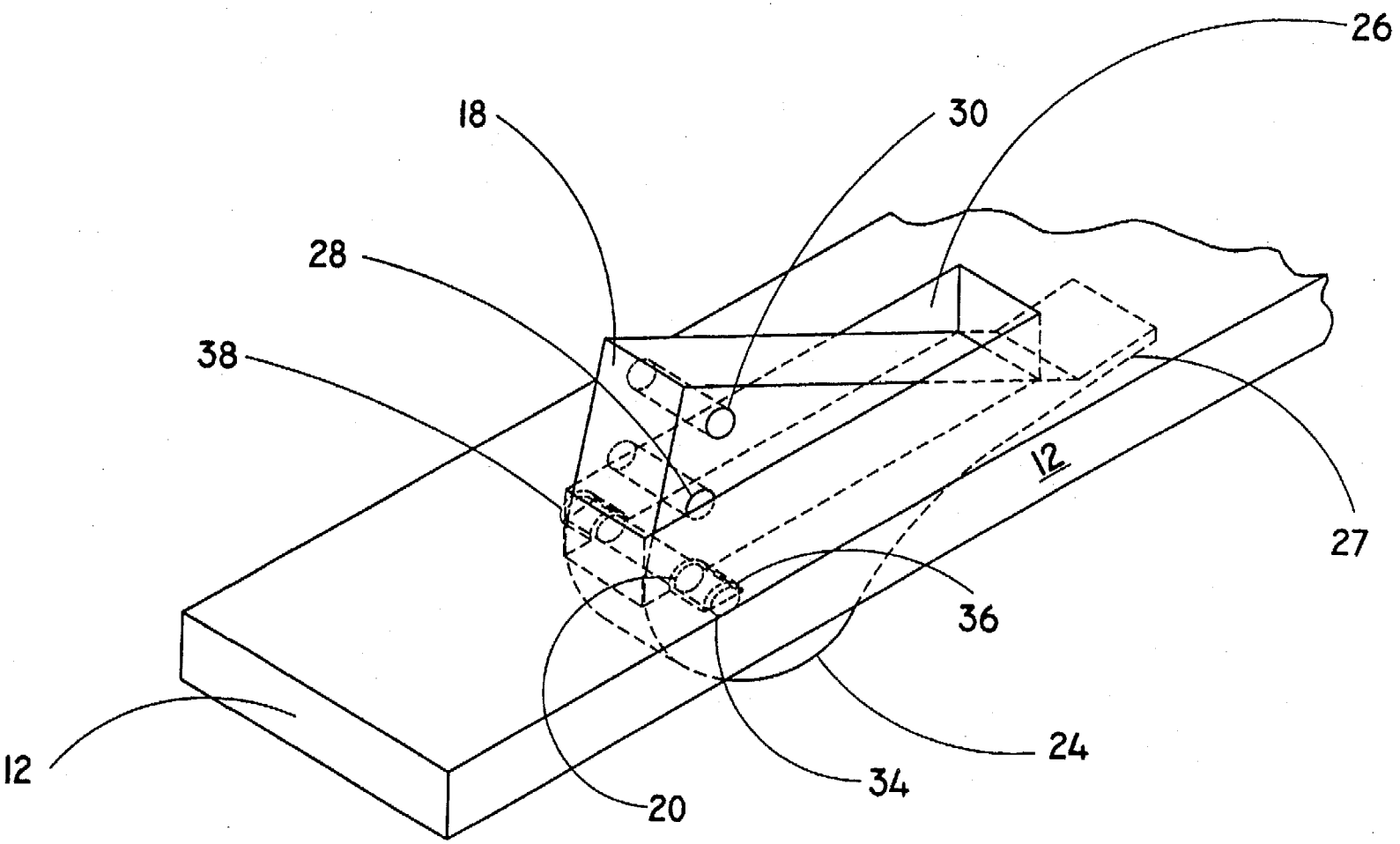
FIG. 2 is a schematic view of the frame with the furniture foot installed, shown partially in phantom.

Referring now to FIG. 2, the holes 20, 28, and 30 can be seen. The foot 18 is resident in a slot 26 formed in the bottom frame 12. A pin 34 is shown passing through the lower hole 20 and having an end portion protruding from either side of the foot 18. Also, extending from either side of the slot 26 are grooves 36, 38 aligned with one another and adapted to receive the pin 34 and securely locate it within the two grooves when the foot 18 is mounted in the slot 26. The foot 18 is configured in a generally wedge-shaped configuration having a first end terminating in a flat tab 27 and a second end in which the holes 20,28,30 are formed. The lower portion of the second end is provided with a curved surface 24, which can securely and solidly contact a floor at any of several different angles. Note that the wedge-shaped foot 18 is of a length such that, when the upper end of the foot is located in the slot, the flat tab 27 protrudes below and beyond the slot 26, thus providing support for the bottom frame 12.

As can be appreciated, the foot height can be adjusted by lowering the foot 18 out of the slot 26 and changing which of the holes 20, 28, and 30 receives the pin 34. Locating the pin 34 in the lower hole 20 as seen in FIG. 2 results in a lower height for the bottom frame 12 off the floor. If the pin 34 is located in a higher hole 28 or 30, the foot extends further below the frame 12, causing the frame 12 to be located at a higher elevation off the floor. In all cases, the tab 27 provides support for the bottom frame 12.

In changing the height of the foot 18 by changing the hole 20,28,30 in which the pin 34 is inserted, the net effect is to cause a rotation of the second part of the foot 18 about the flat tab 27. As such, it is appropriate that the holes 20, 28, and 30 be located on a curve, such as the circumference of the circle of which a point on the tab 27 is the center. However, other hole alignments can be used.

Referring back to FIG. 1, the foot 18 shown in that figure is provided with hollowed-out recess 22 to decrease the weight and amount of material used in making up the foot 18. This is particularly preferred if the foot is to be made of molded plastic. If the foot is of another material, such as carved wood, it may be preferable to omit the recess 22.

For an upholstered seat that, as is typical, has four feet, the bottom frame 12 will be provided with four slots 26 and four respective feet 18 and corresponding pins 34. In a preferred embodiment, all of the feet and pins 18 and 34 are identical, although it is not necessary that that be the case. Generally, the feet are arranged in the seat 10 at the corners of a square or rectangle, two being at the front of the seat and two being at the rear of the seat. As seen in FIGS. 3A through 3I, the seat 10 can thus be provided with a multiplicity of heights and fore-and-aft tilts, depending on the selection of the holes 20,28,30 in which the pins are mounted in their respective feet. By doing so, the height of the actual sitting surface 32 off the floor 40 can be adjusted.

Figures 3A, 3B, 3C, 3D, 3E, 3F, 3G, 3H, 3I:
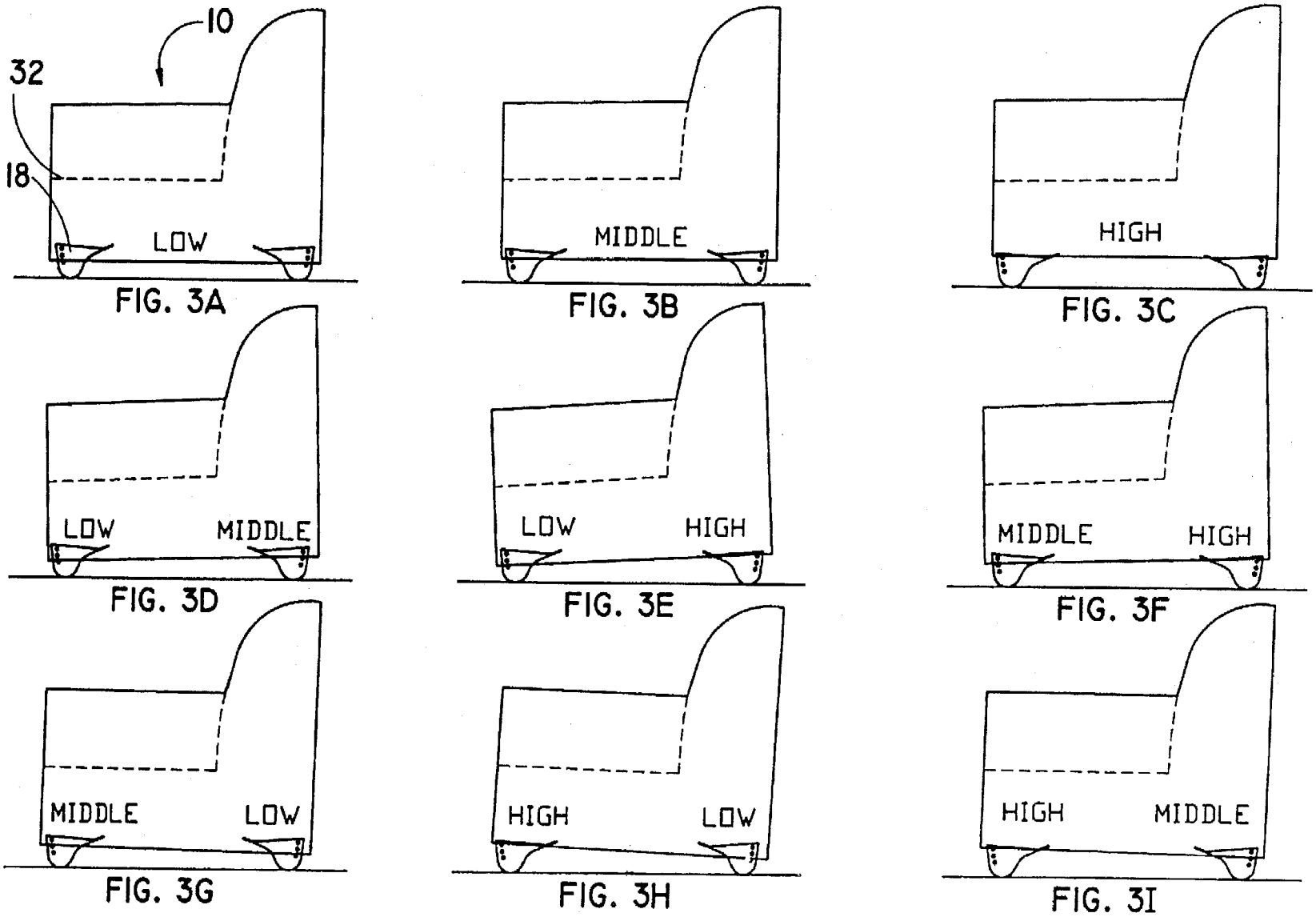
FIGS. 3A–I are schematic end views of an upholstered furniture piece showing the possible orientations of the furniture arising from various configurations of adjustment of the furniture foot.

In FIG. 3A, both the front and rear feet are pinned to the lowermost hole 20 to cause a low, horizontal seat support.

In FIG. 3B, the front and rear feet are all pinned through the middle hole 28 to cause a middle height, horizontal seat.

In FIG. 3C, both the front and rear feet are pinned in the top hole 30 to cause a high, horizontal seat.

In FIG. 3D, the forward feet are pinned in the lowermost hole 20 and the rear feet are pinned in the middle hole 28 to cause a relatively low, forward tilting seat. The forward tilt is of assistance to the elderly or infirm to raise themselves out of the seat.

In FIG. 3E, the forward feet are pinned in the lower hole 20 and the rear feet are pinned in the top hole 30 to provide an even greater forward tilt to the seat 10.

In FIG. 3F, the forward feet are pinned in the middle hole 20 and the rear feet are pinned in the top hole 30 to provide a forward tilt at a greater height than in FIG. 3D.

In FIG. 3G, the forward feet are pinned in the middle hole 28 and the rear feet are pinned in the rear hole 20 to cause a backward tilt at a relatively low level. For a consumer who prefers to have a slight recliner feel to the seat 10, this orientation may be preferred.

In FIG. 3H, the front feet are pinned in the uppermost hole 30 and the rear feet are pinned in the lower hole 20 to provide a steeper rearward tilt.

In FIG. 3I, the front feet are pinned in the top hole 30 and the rear feet are pinned in the middle hole 28 to provide a rearward tilt of a moderate degree at a higher height than is achieved in FIG. 3G.

The number of holes in each foot can be selected as desired. Also, the amount of tilt achievable will be determined by the spacing between the holes as well as the spacing fore-and-aft of the feet on the seat 10. While the seat has been described as having four feet, other numbers of feet can also be used. For example, a long, heavy sofa might have six feet, with three in the front and three in the back. Also, one may contemplate the use of as few as three feet in a triangular orientation. Similarly, the invention could also be used with two feet of fixed height, and two feet being adjustable as set forth herein to provide for the tilting capability, but lacking some of the full height adjustment range.

By upholstered seat, as used herein, it is meant sofas, loveseats, chairs, ottomans, chaise lounges and the like.

Those of ordinary skill in the art will appreciate that the invention can be carried out in various ways other than specifically described herein, and the scope of this invention is deemed to be broad enough to encompass all such variations falling within the scope of the claims and their equivalents.

What is claimed is:

1. A furniture foot for an upholstered seat comprising a body having a thickness, a first end, and a second end having a lower portion and a plurality of holes, and a pin having two ends and a length greater than said thickness of said body, whereby said pin may be inserted into one of said holes so each end protrudes from said body, said body may be located in a slot in a bottom of a frame member of an upholstered seat, with said protruding pin lodged in a groove in said frame member and said first end extending below said frame member outside of said slot, to form a foot on the upholstered seat.

2. A furniture foot as claimed in claim 1 wherein said holes are aligned with one another along a line that is generally transverse to a line between said first end and said second end.

3. A furniture foot as claimed in claim 1 wherein said lower portion is configured for solid contact with a flat floor at a plurality of orientations.

4. A furniture foot as claimed in claim 3 wherein said lower portion is curved.

5. A furniture foot as claimed in claim 1 wherein said end is considerably wider than said first end.

6. A furniture foot as claimed in claim 1 wherein there are at least three of said holes and said holes are aligned with one another along a curved line that is generally transverse to a line between said first end and said second end.

7. A furniture foot as claimed in claim 1 wherein said body is generally wedge-shaped.

8. A furniture foot as claimed in claim 1 wherein said first end is tapered.

9. A furniture foot for an upholstered seat comprising a body having a thickness, a first end that terminates in a flat tab, and a second end having a lower portion and a plurality of holes, and a pin having two ends and a length greater than said thickness of said body, whereby said pin may be inserted into one of said holes so each end protrudes from said body, said body may be located in a slot in a bottom of a frame member of an upholstered seat, with said protruding pin lodged in a groove in said frame member and said first end extending below said frame member outside of said slot, to form a foot on the upholstered seat.

10. A furniture foot for an upholstered seat comprising a body having a thickness, a first end terminating in a flat tab, and a second end having a lower portion curved for solid contact with a flat floor at a plurality of orientations and at least three holes aligned with one another along a curved line that is generally transverse to a line between said first end and said second end, and a pin having two ends and a length greater than the thickness of said body, whereby said pin may be inserted into one of said holes so each end protrudes from said body, said body may be located in a slot in a bottom of a frame member of an upholstered seat, with the protruding pin lodged in a groove in the frame member and the first end extending below the frame member outside of said slot, to form a foot on the upholstered seat.

11. An adjustable-height upholstered seat comprising a frame including support of a seated person at a seat height, said frame including a bottom having a plurality of slots formed therein, each said slot having a groove extending from either side thereof, a plurality of furniture feet each including a body having a thickness, a first end, and a second end having a lower portion and a plurality of holes, and a plurality of pins, each having two ends and a length greater than the thickness of a respective body, each of said pins inserted into a selected one of said holes in a respective furniture foot so each pin end protrudes from its furniture foot, each said furniture foot body located in one of said slots in said bottom of said frame, with the protruding pin lodged in said groove in the frame member and the first end extending below the frame member outside of said slot, to form a foot on the upholstered seat, whereby said seat height may be adjusted by inserting the pins in different ones of said holes in said furniture foot.

12. A seat as claimed in claim 11 wherein said plurality of furniture feet are four in number and are identical.

13. A seat as claimed in claim 11 wherein said slots are slightly wider than the thickness of said furniture feet.

14. A seat as claimed in claim 11 wherein said furniture foot body is generally wedge-shaped.

15. A seat as claimed in claim 11 wherein said first end of said furniture foot is tapered.

16. A seat as claimed in claim 11 wherein said second end of said furniture foot is considerably wider than said first end of said furniture foot.

17. A method of adjusting the height of an upholstered seat comprising the steps of a. inserting a pin in a selected one of a plurality of holes in a furniture foot that has a body having a thickness, a first end, and a second end having a lower portion, b. repeating step a with additional pins and furniture feet to make a plurality of pinned furniture feet, c. providing a frame for support of a seated person, the frame including a bottom having a plurality of slots formed therein, each slot having a groove extending from either side thereof, d. locating each of the pinned furniture feet in one of the slots in the bottom of the frame with the first end below the frame member outside of said slot, and e. lodging the protruding pin in the groove in the frame member to form a foot on the upholstered seat.

18. A method as claimed in claim 17 further comprising changing the height of at least a portion of the seat by removing at least one of the pinned furniture feet from the bottom of the frame, changing the hole in which the pin is inserted, and relocating the foot in the slot.

19. A method as claimed in claim 17 wherein the seat is tilted forward by locating the pins in holes in forward-most furniture feet to cause the effective height of the forward-most feet to be shorter than the height of rear feet.

20. A method as claimed in claim 17 wherein the seat is tilted rearward by locating the pins in holes in rearward-most furniture feet to cause the effective height of the rearward-most feet to be shorter than the height of forward feet.

* * * * *